United States Patent [19]

Heater

[11] 4,269,408

[45] May 26, 1981

[54] METHOD AND MEANS FOR STACKING FLAT FLEXIBLE SHEETS

[76] Inventor: Charles P. Heater, P.O. Box 68, Lake Lure, N.C. 28746

[21] Appl. No.: 56,872

[22] Filed: Jul. 12, 1979

[51] Int. Cl.[3] ..... B65H 31/08

[52] U.S. Cl. ..... 271/212; 271/186; 271/190

[58] Field of Search ..... 271/186, 190, 212, 69, 271/73, 65, 66

[56] References Cited

U.S. PATENT DOCUMENTS

| | | | |
|---|---|---|---|
| 3,163,415 | 12/1964 | Atchison | 271/186 |
| 3,370,849 | 2/1968 | Martin | 271/186 X |

*Primary Examiner*—Richard A. Schacher
*Attorney, Agent, or Firm*—Clifton T. Hunt

[57] ABSTRACT

A stacker for flat flexible sheets, such as pillow cases, is provided to add sheets to the bottom of a stack without relative frictional movement between the articles being stacked or between the stacking mechanism and the stacked articles. The stacker comprises a stacking plate, clamp bars adjacent the leading edge of successive sheets, and a fold bar movable in a fixed path above and rearwardly of the stacking plate against the upper surface of successive sheets while gripped at their leading edges. Movement of the fold bar under the stack while the leading edge of the sheet is clamped at the front of the stack folds the sheet on itself while the fold bar moves beyond the clamping mechanism toward the rear of the stack and positions the surface of the sheet opposite that engaged by the fold bar against the lower surface of a previously stacked sheet without frictional movement between the two sheets or between the fold bar and the last stacked sheet. The action is much like unrolling a rug on a floor, there being no frictional movement between the rug and the floor. The clamp bars are released after the sheet is added to the stack and means are provided to elevate the stacking plate above the clamp mechanism to position the trailing edge of the last added sheet on top of the clamp mechanism.

7 Claims, 7 Drawing Figures

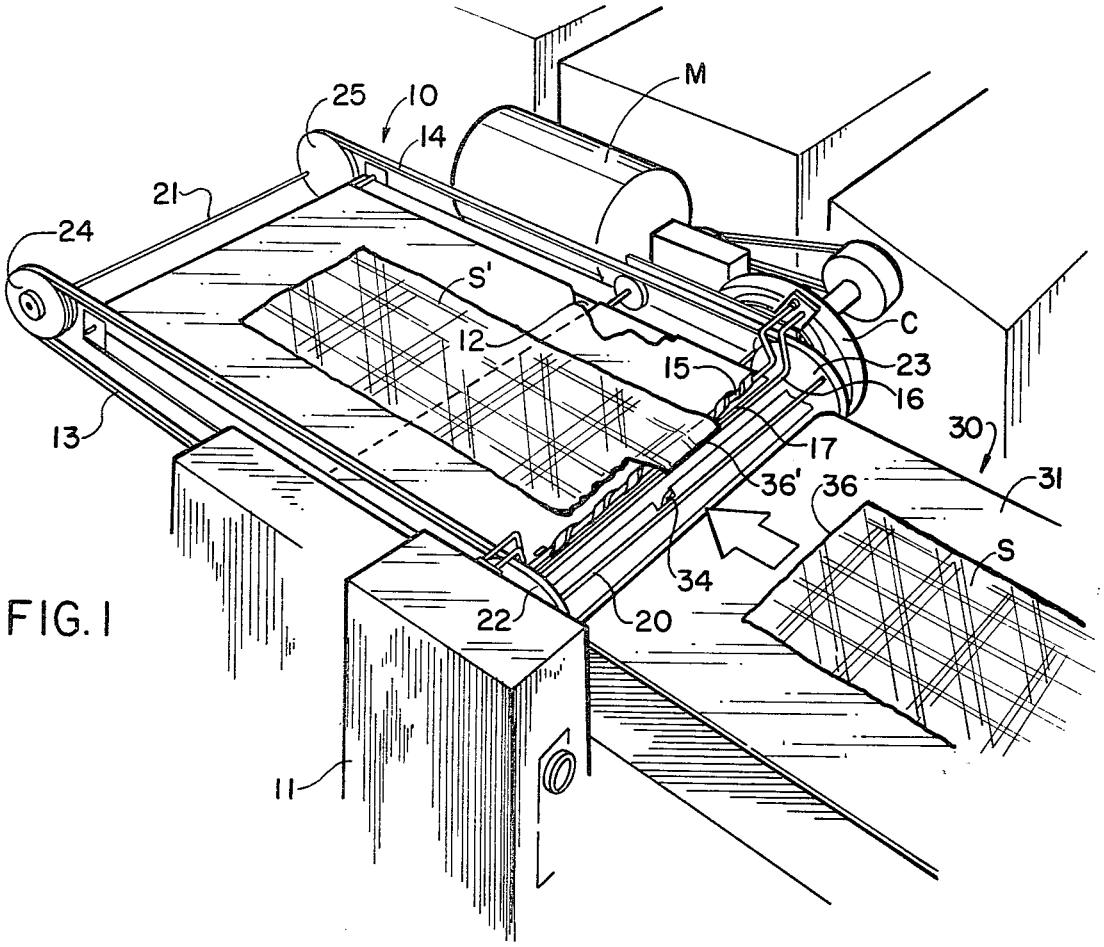
FIG. 1
FIG. 2
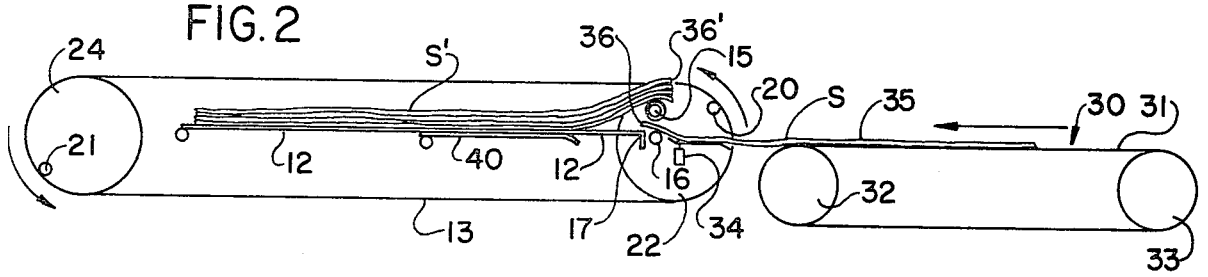
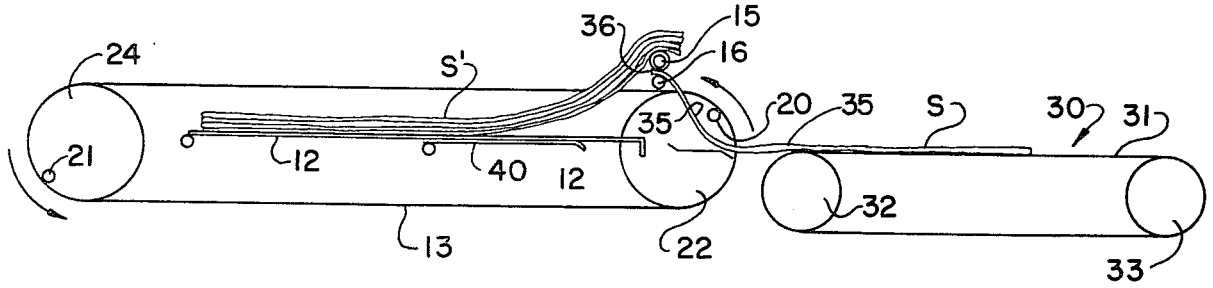
FIG. 3

METHOD AND MEANS FOR STACKING FLAT FLEXIBLE SHEETS

BACKGROUND OF THE INVENTION

Stacking machines which build the stack from the bottom have long been known. U.S. Pat. No. 2,488,674 issued Nov. 22, 1949 to Clifton S. Mallott, Jr. is an example of such a stacker. U.S. Pat. No. 3,568,860 issued Mar. 9, 1971 to Phillip G. Rollins and U.S. Pat. No. 3,861,538 issued Jan. 21, 1975 to Yakov Duchinsky et al are other examples of bottom stackers. These machines use a series of fingers to temporarily support a stack while an article is added beneath the stack. After the article to be added is in place the fingers are withdrawn from the bottom of the stack permitting it to fall on the newly added article. The withdrawal of the fingers is accomplished by sliding the fingers along the last previously stacked article and the sliding movement of the fingers results in frictional relative contact between the stacking fingers and the bottom most article in the stack.

Such frictional abrasion is sometimes objectionable as when the weight of a stack of fragile articles such as lacework or fragile loosely woven or non-woven goods or fragile paper articles coupled with frictional relative movement damages the stacked articles. An example of such articles is the disposable paper sleeves worn by members of the staff in some operating rooms.

SUMMARY OF THE INVENTION

The bottom stacker of the present invention adds articles to the bottom of the stack without creating relative movement between the last stacked article and the article being stacked.

It is an object of the invention to provide a machine for stacking articles from the bottom, which machine includes a stacking plate and clamp means underlying the front end of the stacking plate, means for feeding successive flat flexible articles to the clamp means to grip the leading edges of successive articles, a transversely extending fold bar movable rearwardly between the stacking plate and articles stacked on it and against the upper or first surface of a flat flexible article clamped at its leading edge by said clamp mechanism in advance of the stacking plate, means for moving the fold bar across the stacking plate against the first surface of said article to reverse the article engaged by the fold bar and lay the opposite or second surface of the article against the previously stacked article as the fold bar moves toward the rear of the stacking plate.

It is also an object of this invention to provide a machine of the type described including means for elevating the end of the stacking plate proximate the clamp bar to position the last stacked article on top of the clamp bar as the clamp bar releases said leading edge of that article.

It is another object of this invention to provide a machine of the type described wherein means are provided for feeding successive articles to the clamp bar and stacking plate.

It is another object of this invention to provide a machine of the type described which will permit the bottom stacking of fragile sheets without imparting relative frictional movement against the last stacked sheet.

It is another object of this invention to provide a machine of the type described wherein successive articles may be automatically fed to the machine and automatically successively stacked from the bottom in an efficient manner.

BRIEF DESCRIPTION OF THE DRAWINGS

FIG. 1 is a perspective view of the stacking machine; FIGS. 2–7 are somewhat schematic and sequential views of the operative parts of the stacking machine and an associated feed conveyor illustrating the sequence of steps in clamping and reversing successive flat flexible sheets as they are laid on the stacking plate and against a previously stacked sheet.

DETAILED DESCRIPTION OF THE INVENTION

Figure 4:
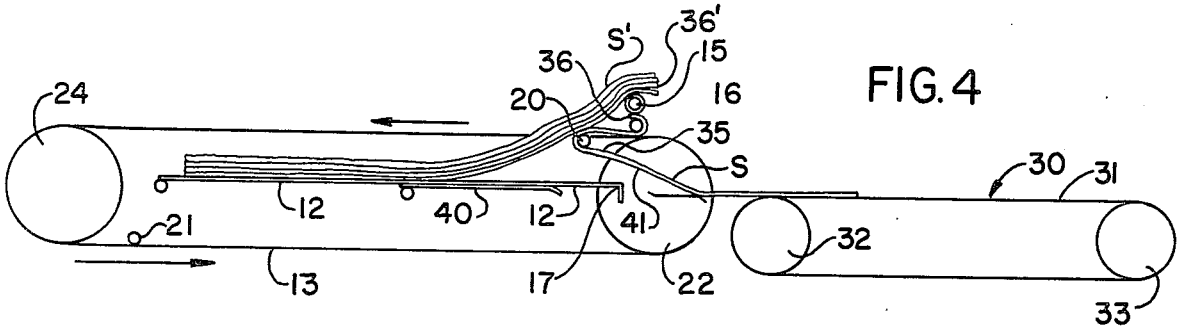

Referring more specifically to the drawings, the numeral 10 broadly designates a stacking machine comprising a base 11 supporting a stacking plate 12 between a pair of motor driven endless belts 13 and 14. Cam actuated clamp bars 15 and 16 extend transversely slightly in advance of the front end 17 of stacking plate 12. Fold bars 20 and 21 extend transversely between corresponding flights of the endless belts 13, 14 and are movable therewith in the direction indicated by the directional arrows in FIGS. 2–5 .

The endless belts 13 and 14 extend around respective drive pulleys 22 and 23 and respective idler pulleys 24, 25. A feed conveyor broadly indicated at 30 and comprising an endless belt 31 trained about a drive pulley 32 and an idler pulley 33 is positioned in advance of the stacking mechanism 10 and closely adjacent the front end of stacking plate 12.

Successive flat flexible sheets S are fed by the conveyor 30 to the stacking machine 10 and as each successive sheet S enters machine 10 it first engages a microswitch 34 to initiate a cycle of operation of the machine 10.

Figure 5:
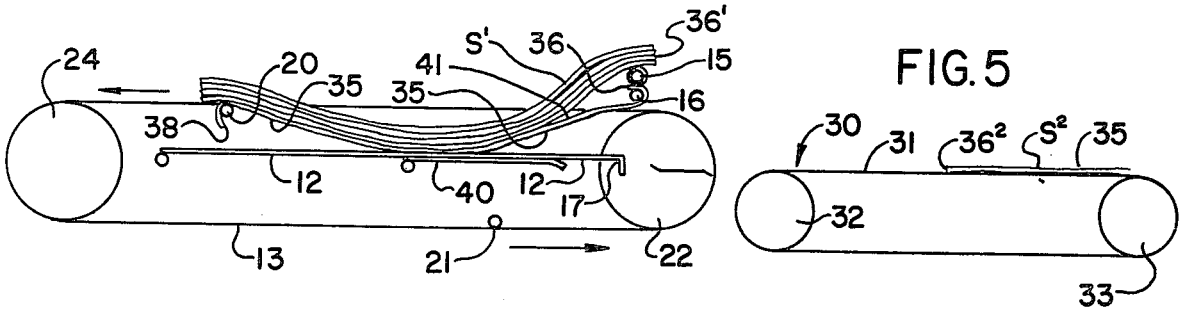
Figure 6:
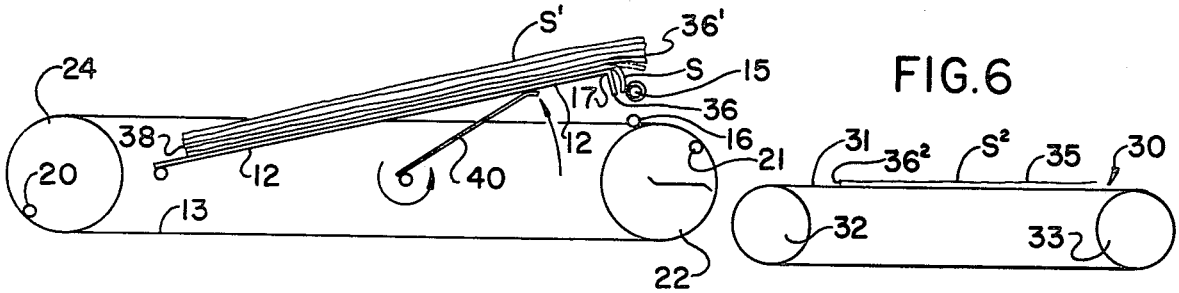
Figure 7:
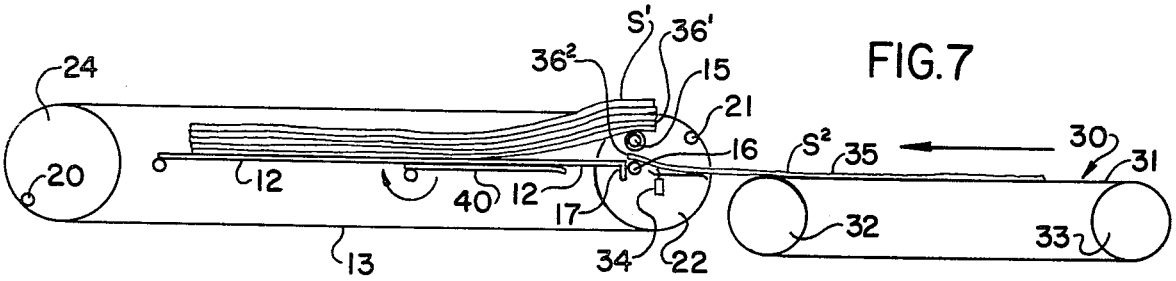

In operation, a motor M is energized by switch 34 to rotate a master cam C that cycles the fold bars 20, 21 and clamp bars 15, 16 to successively clamp the leading edge of successive sheets S (FIG. 2), after which the fold bar 20 moves against the upper or first surface 35 of sheet S (FIGS. 3, 4 and 5). The fold bar 20 is positioned to engage the upper surface or first surface 35 of sheet S by locating fold bar 20 above sheet S as it engages microswitch 34 (FIG. 2) and moves between the spaced clamp bars 15, 16 in their open or inoperative position. Next, the cam C moves the clamp bars upwardly above the top flight of endless chain 13 and 14 between which fold bars 20 and 21 extend transversely of the machine (FIGS. 3–7). The lower clamp bar 16 moves upwardly a greater distance than upper clamp bar 15 to trap the leading edge 36 of flat flexible sheet S between the clamp bars 15, 16 as shown in FIGS. 3, 4 and 5. The upper clamp bar 15 is preferably wrapped with a soft resilient material such as sponge rubber indicated at 37 to effectively grip and hold the leading edge 36 of sheet S during the remainder of the stacking operation.

After the leading edge 36 of sheet S is firmly gripped between clamp bars 15, 16 the cam C cycles a first fold bar 20 into engagement with the upper surface 35 of sheet S (FIG. 4). The clamp mechanism remains elevated above the endless chains 13, 14 as they move in the direction indicated in FIGS. 4 and 5 to carry the fold bar 20 across the stacking plate 12 while in engagement with the first or upper surface 35 of sheet S. Meanwhile the second fold bar 21 is moved by the chains 13 and 14 toward position to engage a succeeding sheet $S^2$ arriving on feed conveyor 30 (FIG. 5).

After fold bar 20 moves beyond the trailing end 38 of sheet S (FIGS. 5 and 6) the clamps 15, 16 are cycled to move apart by depressing clamp bar 16 relative to clamp bar 15 (FIG. 6) to release the leading edge 36 of sheet S. As sheet S is released from clamp 15, 16 the stacking plate 12 is elevated by upward movement of a lifter bar 40 (FIG. 6) to move the leading edge 36 of sheet S above the upper clamp bar 15.

Meanwhile, succeeding sheet $S^2$ has been moved into position between the open clamp bars 15, 16 after fold bar 21 has come to rest in its initial position above sheet $S^2$ and the leading edge $36^2$ of sheet $S^2$ has contacted microswitch 34 to initiate another cycle.

Referring to FIGS. 4 and 5, movement of fold bar 20 rearwardly of stacking plate 12 while engaging the first surface 35 of sheet S lays the reverse of second surface 41 of sheet S against the previously laid sheet S' and causes the first surface 35 of sheet S to lie against the stacking plate 12. The sheet S is thus reversed in the process of laying it on the stack, much in the manner of unrolling a rug on the floor.

These is thus provided an improved method and means of stacking flat flexible sheets which is particularly adapted for use with fragile sheets requiring handling with a minimum of abrasion.

Although specific terms have been used in the description of the invention, they have been used in a descriptive sense only and not for purposes of limitation.

I claim:

1. A method of bottom stacking flat flexible sheets which comprises the steps of providing a stacking plate, providing a clamping mechanism in advance of the stacking plate, feeding successive sheets to the clamping mechanism, actuating the clamping mechanism to grip the leading edge of each successive sheet, engaging a first surface of each successive sheet after the leading edge of that sheet is clamped, moving each successive sheet across the stacking plate while reversing the sheet upon itself to lay said first surface of the sheet on the stacking plate and the opposite or second surface of each sheet against a previously stacked sheet.

2. A method according to claim 1 which includes the step of positioning the leading edge of each successive sheet on top of the clamp mechanism after that sheet is on the stacking plate.

3. Apparatus for stacking successive flat flexible sheets comprising a stacking plate, means for advancing successive sheets to a stacking plate, each said sheet having a leading edge and a first surface directed away from the stacking plate, clamp means in advance of the stacking plate, means activating said clamp means to engage the leading edge of successive sheets, means for moving each sheet in succession across the stacking plate while its leading edge is clamped to position said first surface against the stacking plate and the opposite or second surface of each sheet against a previously stacked sheet as the sheet is reversed on itself.

4. Apparatus according to claim 3 wherein means are provided for releasing said leading edge of successive sheets after the first surface of each such sheet is positioned against the stacking plate.

5. Apparatus according to claim 4 wherein means are provided for positioning the leading edge of each successive sheet on top of the clamp means after each such leading edge is released by the clamp means.

6. Apparatus according to claim 3 wherein said means for moving each sheet in succession across the stacking plate comprises a fold bar extending transversely of the stacking plate, means locating the fold bar in its initial position above a sheet gripped at its leading edge by said clamp means, and means for moving the fold bar into engagement with said first surface of the sheet and toward the rear of the stacking plate beyond the trailing edge of said sheet while the leading edge of said sheet is gripped by said clamp means, whereby said sheet is reversed on itself and the first surface of said sheet is positioned on the stacking plate.

7. Apparatus for stacking successive flat flexible sheets comprising a stacking plate, means for advancing successive sheets to the stacking plate, each said sheet having a leading edge and a first surface directed away from the stacking plate, clamp means in advance of the stacking plate, means activating said clamp means to engage the leading edge of successive sheets, means for moving each sheet in succession across the stacking plate while its leading edge is clamped to position said first surface against the stacking plate as the sheet is reversed on itself, means for releasing said leading edge of successive sheets after the first surface of each such sheet is positioned against the stacking plate, means for positioning the leading edge of each successive sheet on top of the clamp means after each such leading edge is released by the clamp means, said last named means comprising means for elevating the leading edge of the stacking plate and the leading edges of the sheets stacked thereon above the clamp means with the leading edges of the stacked sheets overlying the clamp means, and means for lowering the stacking plate to position said leading edge of the stacked sheets on top of the clamping means.

* * * * *